US005326466A

United States Patent [19]

Harandi

[11] Patent Number: 5,326,466

[45] Date of Patent: * Jul. 5, 1994

[54] DISTILLATE DEWAXING REACTOR SYSTEM INTEGRATED WITH OLEFIN UPGRADING

[75] Inventor: Mohsen N. Harandi, Langhorne, Pa.

[73] Assignee: Mobil Oil Corporation, Fairfax, Va.

[ * ] Notice: The portion of the term of this patent subsequent to Apr. 13, 2010 has been disclaimed.

[21] Appl. No.: 45,921

[22] Filed: Apr. 12, 1993

Related U.S. Application Data

[63] Continuation-in-part of Ser. No. 644,144, Jan. 22, 1991, Pat. No. 5,202,015.

[51] Int. Cl.[5] ..... C10G 11/04; C10G 11/05

[52] U.S. Cl. ..... 208/120; 208/119; 208/135; 585/653; 585/533

[58] Field of Search ..... 208/77, 78, 79, 111, 208/118, 119, 120, 133, 135; 585/533, 653

[56] References Cited

U.S. PATENT DOCUMENTS

| | | | |
|---|---|---|---|
| 3,891,540 | 6/1975 | Demmel et al. | 208/77 |
| 3,960,978 | 6/1976 | Givens et al. | 260/683.15 |
| 4,332,670 | 6/1982 | Antal | 208/68 |
| 4,419,220 | 12/1983 | LaPierre et al. | 208/111 |
| 4,483,760 | 11/1984 | Tabak et al. | 208/60 |
| 4,541,919 | 9/1985 | LaPierre et al. | 208/111 |
| 4,597,854 | 7/1986 | Penick | 208/58 |
| 4,788,366 | 11/1988 | Harandi et al. | 585/314 |
| 4,997,543 | 3/1991 | Harandi et al. | 208/49 |
| 5,000,840 | 3/1991 | Anthes et al. | 208/111 |
| 5,009,851 | 4/1991 | Avidan et al. | 422/141 |
| 5,053,579 | 10/1991 | Beech, Jr. et al. | 585/533 |
| 5,202,015 | 4/1993 | Harandi | 208/119 |

*Primary Examiner*—R. Bruce Breneman
*Assistant Examiner*—Bekir L. Yildirim
*Attorney, Agent, or Firm*—Alexander J. McKillop; M. D. Keen; L. Gene Wise

[57] ABSTRACT

Catalytic dewaxing of distillate feedstock is carried out concurrently with upgrading of olefins by oligomerization to produce fuel products.

21 Claims, 2 Drawing Sheets

DISTILLATE DEWAXING REACTOR SYSTEM INTEGRATED WITH OLEFIN UPGRADING

REFERENCE TO COPENDING APPLICATIONS

This application is a continuation-in-part of U.S. Patent application Ser. No. 07/644,144 filed Jan. 22, 1991, now U.S. Pat. No. 5,202,015 incorporated by reference

BACKGROUND OF THE INVENTION

This invention relates to techniques, equipment and process unit operations for production of hydrocarbon fuels and low pour point distillate. The invention involves concurrent catalytic oligomerization of $C_5+$ olefinic hydrocarbons with cracking and/or isomerization of lightly branched or normal paraffins in a waxy distillate to produce $C_5+$ gasoline and low pour point distillate. More particularly, the invention involves the advantageous system integration of process units for simultaneous olefin oligomerization and distillate dewaxing into catalytic hydrocarbon cracking processes to permit the common utilization of product separation operations.

Reactor systems and processes for dewaxing petroleum distillates have been known for a long time. Dewaxing is, as is well known, required when highly paraffinic oils are to be used in products which need to remain mobile at low temperatures e.g., lubricating oils, heating oils, jet fuels. The higher molecular weight straight chain normal and slightly branched paraffins which are present in oils of this kind are waxes which are the cause of high pour points in the oils and if adequately low pour points are to be obtained, these waxes must be wholly or partly removed. Catalytic dewaxing processes are employed to selectively crack the longer chain n-paraffins to produce lower molecular weight products which may be removed by distillation. Processes of this kind are described in U.S. Pat. No. 3,668,113.

In order to obtain the detailed selectivity, the catalyst is preferably a shape selective zeolite having a pore size which admits the straight chain n-paraffins or slightly branched paraffins but which excludes more highly branched material, cycloaliphatics and aromatics. Shape selective zeolites of medium pore size (5–7A) or larger (7Å+), such as ZSM-5, ZSM-11, ZSM-12, ZSM-22, ZSM-23, ZSM-34, ZSM-35, ZSM-48 and Zeolite Beta may be employed for this purpose. Medium pore zeolites, especially ZSM-5 (sometimes called "MFI"), have the preferred property of selectivity and their use forms the basis of the Mobil Distillate Dewaxing process ("MDDW"). The MDDW process is usually a fixed bed process that typically operates at 20 to 55 atm (2058 kPa to 5600 kPa), 260–430° C. reactor temperature, and 40–70 $m^3/b$ of hydrogen circulation.

U.S. Pat. No. 4,332,670 (Antal) discloses catalytic dewaxing of FCC light oil with ZSM-5 employing hydrogen recycle. U.S. Pat. No. 4,483,760 (Tabak et al) describes sequential fixed bed dewaxing of middle distillate with flash separation. U.S. Pat. No. 4,419,220 (LaPierre et al.) discloses fluidized bed dewaxing-isomerization of distillate fuel oil over zeolite Beta. U.S. Pat. No. 4,541,919 (LaPierre et al. discloses fluidized bed hydrodewaxing with ZSM-5. U. S. Pat. No. 3,891,540 (Demmel et al) discloses a combined process for catalytic cracking and distillate dewaxing using ZSM-5 catalyst. U.S. Pat. No. 4,181,598 (Gillespie et al) U.S. Pat Nos. 4,283,271 and 4,283,272 (Garwood et al) also describe the Mobil Lube and Distillate Dewaxing Process ("MLDW") using zeolite catalyst. The foregoing patents, of common assignee, are incorporated herein by reference in their entirety.

Conversion of olefins to gasoline and/or distillate product is disclosed in U.S. Pat. Nos. 3,960,978 and 4,021,502 (Givens, Plank and Rosinski) wherein gaseous olefins in the range of ethylene to pentene, either alone or in admixture with paraffins, are converted into a gasoline blending stock by contacting the olefins with a catalyst bed made up of ZSM-5 or related zeolite. In U.S. Pat. Nos. 4,150,062 and 4,227,992 (Garwood et al) discloses the operating conditions for the Mobil Olefin to Gasoline/Distillate ("MOGD") process for selective conversion of $C_3+$ olefins. A fluidized bed process for converting ethene-containing $C_5+$ olefinic hydrocarbonic streams, sometimes referred to as the Mobil Olefin to Gasoline ("MOG") process is described in U.S. Pat. Nos. 4,822,477; 4,873,385; '389 (Avidan et al); 4,855,524 and 4,859,308 (Harandi et al). The reaction phenomena of shape-selective polymerization are discussed by Garwood in ACS Symposium Series No. 218,Intrazeolite Chemistry, "Conversion of $C_2$–$C_{10}$ to Higher Olefins over Synthetic Zerolite ZSM-5", 1983 American Chemical Society.

The olefins contained in an FCC gas plant are an advantageous feed for oligomerization. U.S. Pat. No. 4,090,949 discloses upgrading olefinic gasoline by conversion in the presence of carbon hydrogen-contributing fragments including olefins and a zeolite catalyst and where the contributing olefins may be obtained from a gas plant. U.S. Pat. Nos. 4,456,781, 4,831,203, '204, '205 (Owen, Tabak et al), disclose aspects of related oligomerization processes using an olefinic feedstock derived from FCC effluent.

The conventional MOG process design is concerned with converting light olefins (e.g., ethylene) in a fuel gas stream, such as an FCC off-gas, to gasoline. Motor octane of the gasoline produced is generally about 80–85. Typically, paraffins conversion under MOG process conditions is not significant.

It is an object of the present invention to provide a novel integrated reactor system for the simultaneous dewaxing of distillate fuel oil and the oligomerization of $C_5+$ olefinic hydrocarbon to fuel products. Another object of the invention is to provide this system employing zeolite catalyst in a common conversion reaction zone. Yet another object of the invention is to integrate the foregoing process invention with catalytic or thermal cracking unit operations in order to utilize $C_5+$ olefinic hydrocarbon and may utilize common FCC plant separation vessels.

Another object of this invention is to upgrade simultaneously a light olefinic FCC gas stream and waxy heavier distillate stream along with one or more of the following intermediate hydrocarbon streams: 1) benzene-rich streams, such as reformate $C_6$-rich heart cut; hydrotreated FCC or coker heavy naphtha; pyrolysis gasoline; and light straight run naphtha.

SUMMARY OF THE INVENTION

A novel reactor system configuration and operating technique has been discovered for the concurrent but independent catalytic reaction of waxy distillate and $C_5+$ olefinic hydrocarbon feedstocks that simultaneously results in the dewaxing of distillate feedstock and the oligomerization of $C_5+$ olefinic hydrocarbons to produce olefinic gasoline. In the novel reactor system, under the conditions discovered, the opposing reactions of molecular weight reduction, as exemplified by waxy n-paraffin cracking, and molecular weight growth, as exemplified by olefin oligomerization, have been found to compatibly coexist to achieve the sought after objective of producing gasoline while dewaxing distillate in a single conversion step. It has also been discovered that the novel system can be conveniently integrated with hydrocarbon catalytic cracking operations in a manner which advantageously utilizes the light product recovery plant of the FCC cracking process and/or the cracker main column to facilitate the separation of the products of the novel conversion process.

More particularly, methods and apparatus have been found for the production of $C_5+$ gasoline and dewaxed distillate, comprising: contacting a hydrocarbon feedstream comprising $C_5+$ olefinic hydrocarbon and high pour point distillate rich in waxy n-paraffins with a fluidized bed of acidic shape selective metallosilicate catalyst particles under reaction conditions sufficient to concurrently oligomerize said $C_5+$ olefinic hydrocarbons while cracking said n-paraffins, whereby an effluent vapor is produced containing products comprising C5+gasoline and dewaxed distillate having a low pour point.

An improved integrated process for production and separation of $C_5+$ gasoline and dewaxed distillate products, comprising:

catalytically or thermally cracking a hydrocarbon feedstock to provide a crackate comprising C1–C4 hydrocarbons containing $C_5+$ olefinic hydrocarbons, $C_5+$ gasoline, and distillate rich in waxy n-paraffins;

fractionating the crackate and passing a portion of the $C_5+$ olefinic hydrocarbons plus the distillate containing n-paraffins to a fluidized bed reaction zone containing acidic shape selective metallosilicate catalyst particles under reaction conditions sufficient to concurrently oligomerize said $C_5+$ olefinic hydrocarbons while cracking and/or isomerizing said distillate n-paraffins, whereby an effluent vapor is produced containing products comprising said $C_5+$ gasoline and dewaxed distillate having a low pour point.

DETAILED DESCRIPTION OF THE INVENTION

Figure 1:
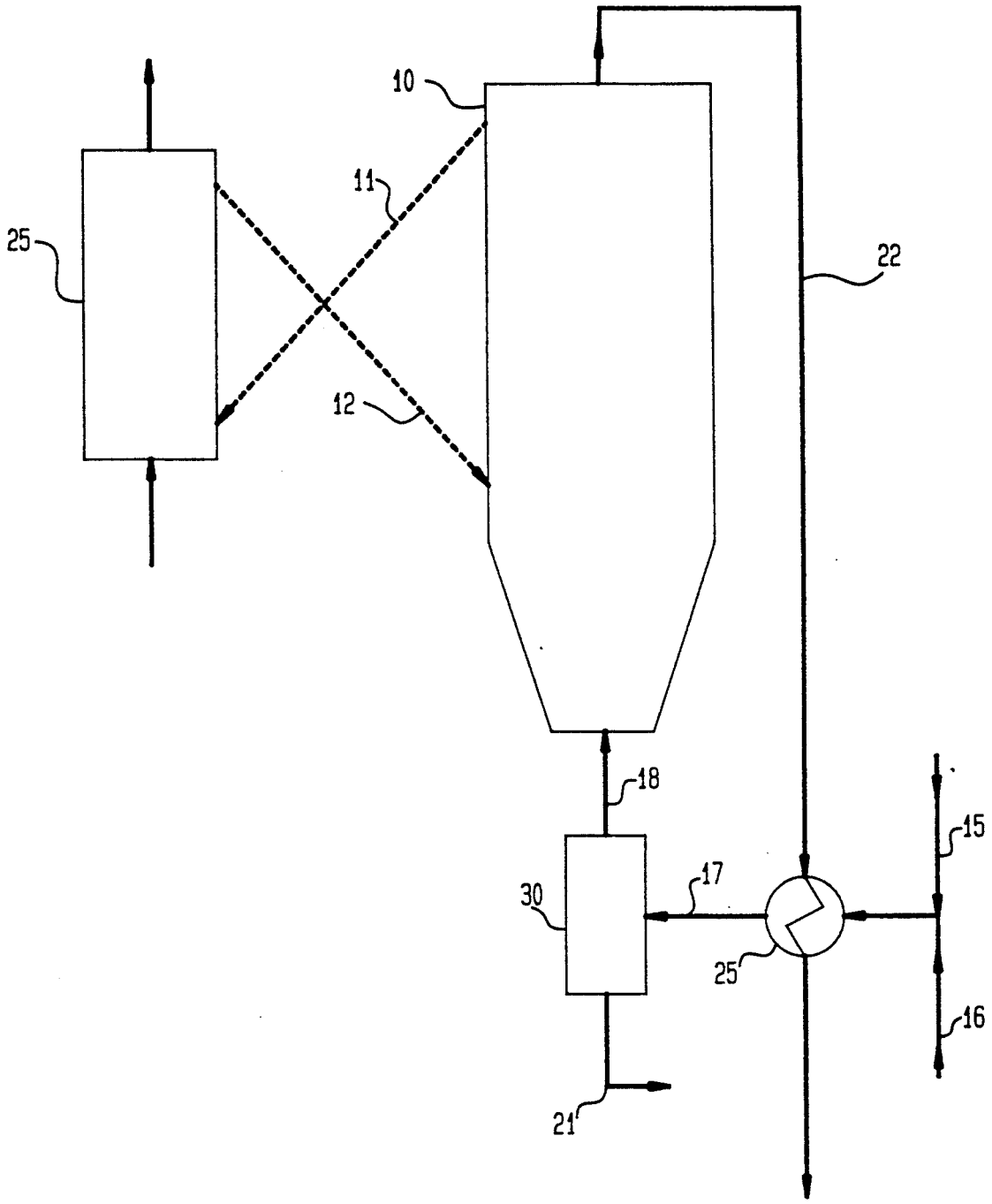
FIG. 1 is a schematic diagram of the present invention depicting the combination of olefin upgrading and distillate dewaxing in a single reactor.

In the following description metric units and parts by weight are employed, unless otherwise indicated.

At least the non-condensible portion of the foregoing effluent is preferably passed to an absorber in contact with lean oil from the catalytic cracking process main fractionator and recovering rich oil containing the products. The rich oil is recycled to the main fractionator along with the condensible portion of said effluent for separating and recovering the products.

In one embodiment of the present invention the Mobil Olefins to Gasoline process (MOG) is combined with distillate dewaxing to produce high $C_5+$ olefinic hydrocarbon conversion as part of a unique fluid bed process for high octane gasoline production, concomitant with the production of dewaxed, low pour point distillate. The MOG process is well-known in the petroleum refining arts and provides a system for upgrading $C_5+$ olefinic hydrocarbons, such as FCC product components, to liquid hydrocarbons, utilizing a continuous process for producing fuel products by oligomerizing olefinic components to produce higher hydrocarbon products for use as fuel or the like.

The preferred MOG feedstock contains medium range $C_5$–$C_6$ alkenes (mono-olefin) in the range of about 10 to 90 wt %, or heavier $C_7$–$C_{12}$ olefins. Non-deleterious components, such as methane and other paraffins and inert gases, may be present. A particularly useful feedstock is a by-product of FCC gas oil cracking units containing typically at least 10 wt % $C_5$–$C_6$ olefins and less than 10 wt % $H_2$ with varying amounts of $C_1$–$C_3$ paraffins and inert gas, such as $N_2$. The process may be tolerant of a wide range of alkanes, from 0 to 90%. Preferred feedstocks contain more than 50 wt % $C_5$–$C_{12}$ lower aliphatic hydrocarbons, and contain sufficient olefins to provide total olefinic partial pressure of at least 50 kPa.

When heavier $C_9+$ olefinic feedstock is employed, a pretreatment by selective hydrogenation can be employed to remove sulfur and nitrogen impurities prior to the main fluidized bed zeolite reactor unit. In this embodiment the main zeolite catalyst to crack n-paraffins, thereby increasing octane of the gasoline-range fuel product. FCC C5's conversion in this reactor results in a significant vapor pressure (RVP) reduction.

Introduction of a light aromatic reformate fraction containing benzene permits alkylation of the benzene in the same reactor unit. The reformate fraction preferably contains about 10–50 wt % benzene. Other additional feedstock materials to be coprocessed along with the olefinic FCC hydrocarbons may include light straight run (LSR) naphtha, preferably $C_6$-$C_7$ fraction.

Olefins as employed herein particularly comprise pentenes, hexenes, heptenes, octenes, nonenes, decenes, dodecenes etc., including terminal and internal monounsaturated olefins. Various isomeric forms are present in conventional FCC olefinic products. Conversion of $C_5+$ olefinic hydrocarbons over HZSM-5 in the upgrading process is effective at moderately elevated temperatures and pressures. Operating details for typical olefin oligomerization units are disclosed in U.S. Pat. Nos. 4,456,779; 4,497,968 (Owen et al.) and 4,433,185 (Tabak), incorporated herein by reference. In the present invention FCC fuel gas is the preferred $C_5+$ olefinic hydrocarbon containing feed. A typical feedstream to the process of the invention contains.

A preferred feedstock includes a waxy distillate (eg, 50–60 wt %), light reformate containing benzene (eg, 20–25 wt %) and an intermediate olefinic stream (eg, 20–25 wt %), such as FCC pentenes, or unreacted olefins from MTBE/TAME etherification processes.

Catalysts useful in the upgrading process and the process of the instant invention include a unique group of metallosilicate zeolites. Recent developments in zeolite technology have provided a group of medium pore siliceous materials having similar pore geometry. Most prominent among these medium (or "intermediate") pore size zeolites is ZSM-5, which is usually synthesized with Bronsted acid active sites by incorporating a tetrahedrally coordinated metal, such as Al, Ga, or Fe, within the zeolitic framework. These medium pore zeolites are favored for acid catalysis; however, the advantages of ZSM-5 structures may be utilized by employing highly siliceous materials or crystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al. ), incorporated by reference.

The oligomerization catalyst preferred for use in olefins conversion and the process of the present invention includes the medium pore (i.e., about 5–7Å (Angstroms)) shape selective crystalline aluminosilicate zeolites having a silica to alumina ratio of about 20:1 or greater, a constraint index of about 1–12, and acid cracking activity (alpha value) of about 1–200, preferably an alpha value between 1 and 10. Representative of the shape selective zeolites are ZSM-5, ZSM-11, ZSM-12, ZSM-22, ZSM-23, ZSM-35, ZSM-48, zeolite Beta and MCM-22.

The term distillate or distillate feedstock as used herein refers to those hydrocarbon products commercially utilized as fuel oil, diesel fuel, tractor oil and the like, following dewaxing. They are typically produced from catalytic or thermal cracking operations and have an initial boiling point between about 160° C. and 250° C., up to about 375° C. at their 90 percent ASTM distillation level. Light distillate boils between about 176° C. and 343° C. while heavy distillate boils above about 342° C. Prior to dewaxing they have a pour point within the range of about −25° C. to +5° C. The waxy distillate can be dewaxed employing the MDDW process under conditions as described herein before, to produce dewaxed distillate with a pour point below −5° C., preferably below −15° C.

The coprocessing of waxy distillate and $C_5$+ olefinic hydrocarbons in a fluidized bed of zeolite catalyst is carried out in the novel process of this invention under moderately low pressure i.e., greater than 140 kPa but preferably between about 200 kPa and 1500 kPa. The reactor operates at a temperature between about 340 and 480° C., but preferably about 400° C. The weight hourly space velocity (WHSV) is greater than 0.1 based on $C_5$+ olefinic hydrocarbon or waxy distillate feed. The feedstock streams may be combined and preheated to a temperature of 260° C. and 415° C.

In a preferred embodiment the process is carried out at a pressure of about 840 kPa and reactor temperature of about 400° C., employing a fluidized bed of ZSM-5 catalyst particles having an alpha value of about 4. Under these conditions the waxy feed is typically a liquid. However, due to the presence of $C_5$+ olefinic hydrocarbonic feed all the distillate can be vaporized. Based on olefins in the feed the WHSV is about 0.5; weight ratio of the feedstock fuel gas to waxy distillate is about 2.0. The combined feedstock is preheated to temperature of 370° C. Under these conditions, a thermally balanced conversion reaction is carried out wherein the oligomerization exotherm produced from olefin oligomerization is partially balanced by the endotherm of n-paraffin cracking reactions provided in the waxy distillate feedstock. The additional heat available from the oligomerization reaction is used to vaporize the waxy feed and preheat the feedstreams. The result is an energy efficient process producing $C_5$+ gasoline and dewaxed distillate. Notably, this result is achieved without adding to the process any more hydrogen than may coincidentally occur in the feedstock; a factor in shape contrast to prior art dewaxing processes.

Referring to FIG. 1, a diagram of the present invention is depicted illustrating the combination of olefin upgrading and distillate dewaxing in a single reaction section. The reactor 10 contains a fluidized bed of acid ZSM-5 catalyst particles connected through conduits 11 and 12 to a catalyst regenerator vessel 20 for oxidative or hydrogenative regeneration of spent catalyst and recirculation of reactivated catalyst to reactor 20. Regeneration may be accomplished at about the same pressure as the reactor and at about 425° C.–600° C. ( preferably about 510° C.). Olefinic feedstream 15 and a waxy distillate feedstream 16 is passed to reactor 10 through conduits 17 and 18, preferably after preheating and heat exchange 25 with product stream 22. Heat exchanger 25 may be disposed internally in the fluid bed reactor 10 to maintain a reactor feed preheat to achieve a desirable reactor effluent temperature. This configuration is particularly preferred since it results in a maximization of feed preheat which allows a higher potential for vaporizing all the distillate feed prior to entering the fluid bed reactor. A knock-out pot 30 is included to remove any unvaporized feed through conduit 21. The reaction products comprising $C_5$+ gasoline and dewaxed distillate are removed, preferably overhead, from the reactor and separated downstream by absorption and/or distillation means not shown. Applying the aforesaid preferred operating conditions to the process configuration of FIG. 1 results in the uniquely advantageous utilization of a single vessel or single reactor system to produce both gasoline by olefin oligomerization and dewaxed distillate by paraffin cracking.

Figure 2:
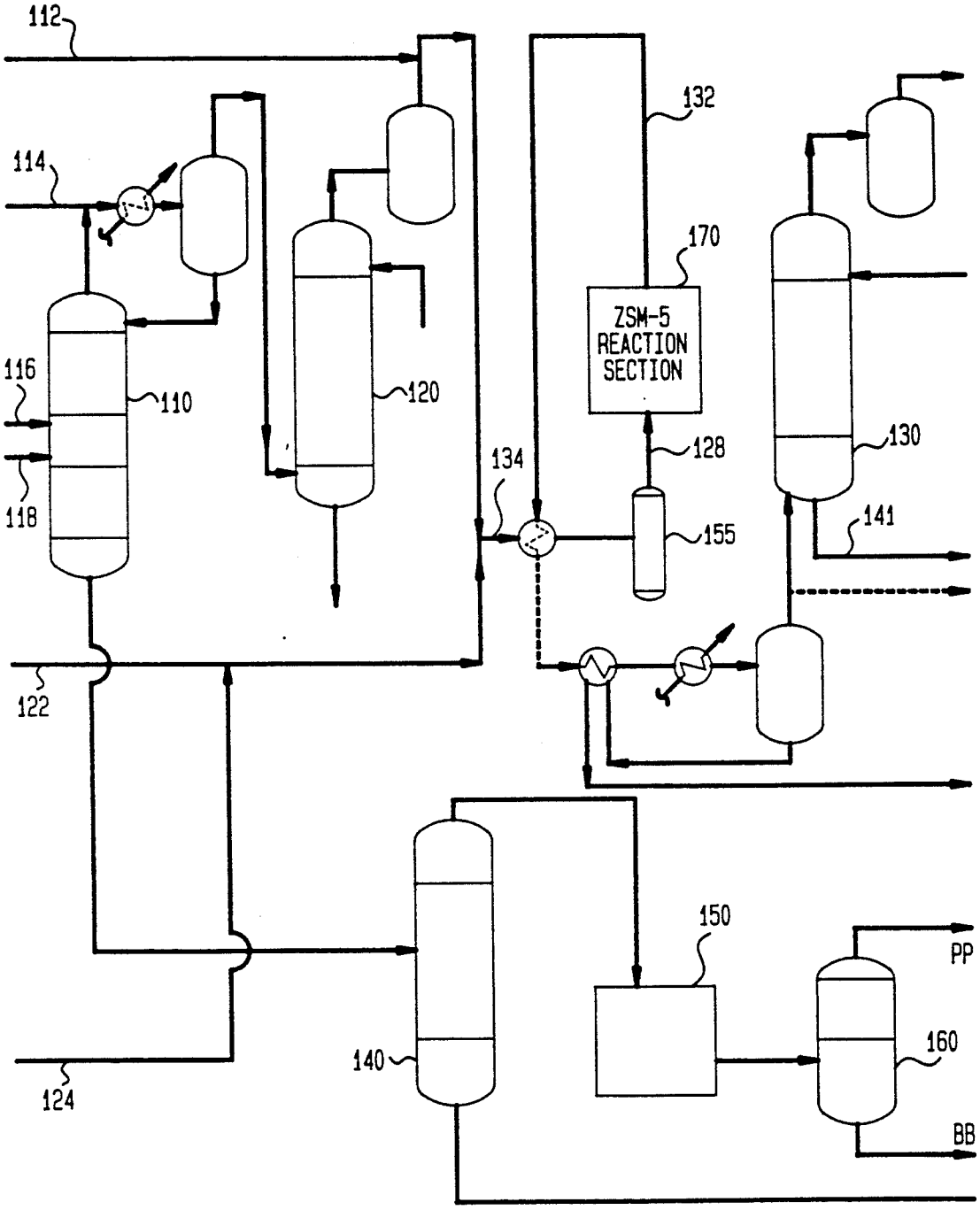
FIG. 2 is a schematic diagram of the invention illustrating a mode of integration with the unsaturated gas plant of a fluid catalytic cracking (FCC) process.

Referring now to FIG. 2, another embodiment of the present invention is presented illustrating a mode of integration with the FCC product recovery plant of a fluid catalytic cracking (FCC) process. The FCC plant contains the conventional separation vessels known in the art, i.e., de-ethanizer 110, amine absorber 120, sponge absorber 130, debutanizer 140, Merox unit and depropanizer 160. Integrated into the reactor system is the fluidized bed reactor section 170 for olefins oligomerization and distillate dewaxing under conditions described above.

The feedstreams to the system include waxy distillate 112, unstabilized gasoline 114, gas and liquid de-ethanizer feeds 116 and 118, propane/propene stream 122, and benzene rich feed 124. The light hydrocarbons from de-ethanizer 110, optional benzene rich feed 124 and distillate 112 comprise the feedstock to reactor 170 introduced through conduit 128, following liquids removal, if any, in knockout pot 155. Reaction products 132 are employed to preheat the reaction feedstream 134. The reaction products are further separated in sponge absorber 130 wherein the rich oil containing products of the oligomerization and dewaxing reactions can be passed to the main FCC fractionator for separation and recovery.

When the option is exercised to include a benzene feedstream 124 to the process, alkylation of the benzene with $C_5$+ olefinic hydrocarbons will be realized in the process. It has been found that olefin containing gasoline streams such as FCC $C_5$–$C_9$ hydrocarbon streams can be upgraded in the fluid bed reactor to improve product quality and/or partially upgrade it to distillate range ($C^{10}$ +) hydrocarbon products. Typically, about 25–45% of benzene in the feed is upgraded to alkyl-benzene components.

A particular advantage of the distillate dewaxing carried out by the techniques of this invention is that the dewaxed distillate is partially desulfurized and denitrogenized in the course of the process. Accordingly, not only is the distillate product of the invention improved with respect to a lower pour point but the capability to simultaneously meet sulfur and nitrogen product specification is enhanced, without requiring any hydrogen addition, separation, desulfurization or denitrogenization unit operations.

While the invention has been described by particular example, there is no intention to limit the inventive concept except at set forth in the following claims.

I claim:

1. A process for the production of fuel and dewaxed distillate products, comprising:

contacting hydrocarbon feedstreams comprising $C_5$+olefinic hydrocarbon and high pour point distillate rich in waxy n-paraffins with a fluidized bed of acidic shape selective medium pore metallosilicate catalyst particles under reaction conditions comprising temperature of 340° C. to 380° C. and weight hourly space velocity greater than 0.1/hr, based on olefin feed, to oligomerize said olefinic hydrocarbons concurrently, while cracking and/or isomerizing said n-paraffins, whereby an effluent vapor is produced containing products comprising fuel range hydrocarbon product and dewaxed distillate product having a low pour point.

2. The process of claim 1 wherein said process is carried out in the substantial absence of added hydrogen; wherein said light olefin comprises $C_5$–$C_{12}$ monoolefin.

3. The process of claim 1 wherein said olefinic hydrocarbon and high pour point distillate feedstreams comprise a product stream from a catalytic or thermal cracking process.

4. The process of claim 1 wherein said reaction conditions comprise pressure greater than about 140 kPa.

5. The process of claim 4 wherein said conditions further include feed preheat temperature between about 260° C. and 415° C.

6. The process of claim 1 wherein said reaction conditions comprise pressure of about 840 kPa, temperature of about 400° C., weight hourly space velocity of about 0.5/hr. based on olefins in the feed, weight ratio of light olefin to distillate of about 2:1, and feed preheat temperature of about 370° C.

7. The process of claim 1 wherein said conditions comprise contacting said feedstreams at a rate sufficient to thermally balance oligomerization reaction exotherm with n-paraffin cracking reaction endotherm.

8. The process of claim 1 wherein said catalyst has an alpha value greater than about 2 and said catalyst comprises acid ZSM-5.

9. The process of claim 1 where said high pour point distillate comprises high nitrogen and/or sulfur content distillate and said dewaxed distillate includes partially desulfurized and/or denitrogenized dewaxed distillate.

10. The process of claim 1 including the steps of: passing reaction effluent from said fluidized bed to an absorber in contact with lean oil from a catalytic cracking process main fractionator; recovering rich oil containing said products; recycling said rich oil to said fractionator; and separating and recovering said products.

11. The process of claim 1 wherein said hydrocarbon feedstream includes benzene, olefins and waxy distillate; and said reaction conditions are sufficient to concurrently oligomerize said light olefins while cracking and/or isomerizing said n-paraffins and alkylate said benzene, whereby an effluent vapor is produced containing products comprising said $C_5$+ gasoline containing alkyl armomatics and dewaxed distillate having a low pour point.

12. The process of claim 1 wherein said olefinic hydrocarbons and distillate are passed to said fluidized bed reaction zone in conjunction with benzene feedstream under reaction conditions sufficient to concurrently oligomerize said light olefins while cracking and/or isomerizing said n-paraffins and alkylating said benzene, whereby an effluent vapor is produced containing products comprising said $C_5$+ gasoline containing alkylaromatics and dewaxed distillate having a low pour point.

13. The process of claim 1 wherein said hydrocarbon feedstream contains $C_6$–$C_7$ aliphatics.

14. The process of claim 13 wherein said feedstream comprises light straight run naphtha.

15. The process of claim 13 wherein said feedstream comprises pyrolysis gasoline or coker gasoline.

16. An integrated process for the production and separation of $C_5$+ gasoline and dewaxed distillate products, comprising:

cracking hydrocarbon feedstock to provide a crackate comprising $C_5$–$C_{12}$ hydrocarbons containing olefins and distillate rich in waxy n-paraffins;

fractioning said crackate and passing a portion of said light hydrocarbons containing olefins plus said distillate to a fluidized bed reaction zone containing acidic shape selective metallosilicate catalyst particles under reaction conditions sufficient to concurrently oligomerize said propene while cracking and/or isomerizing said distillate n-paraffins, whereby an effluent vapor is produced containing products comprising $C_5$+ gasoline and dewaxed distillate having a low pour point;

passing at least a portion of said effluent to an absorber in contact with lean oil from said cracking process main fractionator and recovering rich oil containing said products;

recycling said rich oil to said main fractionator; and separating and recovering said products.

17. The process of claim 16 wherein said reaction conditions comprise pressure greater than about 140 kPa, temperature of 340 to 480° C., weight hourly space velocity greater than 0.1/hour based on olefins or distillate in the feed.

18. The process of claim 17 wherein said conditions further include feed preheat temperature between about 260 ° C. and 415 ° C.

19. The process of claim 16 herein said reaction conditions comprise pressure of about 840 kPa, temperature of about 400° C., weight hourly space velocity of 0.5 /hour based on olefins in the feed, weight ratio of $C_5$+ olefinic hydrocarbon to distillate of about 2:1, and feed preheat temperature of at least 3701° C.

20. The process of claim 16 wherein said conditions comprise contacting said feedstreams at a rate sufficient to thermally balance said $C_5$+ olefinic hydrocarbon oligomerization exotherm with said n-paraffin cracking endotherm.

21. The process of claim 16 wherein said catalyst has an alpha value greater than about 2; and wherein said catalyst comprises ZSM-5.

* * * * *

UNITED STATES PATENT AND TRADEMARK OFFICE

CERTIFICATE OF CORRECTION

PATENT NO. : 5,326,466
DATED : July 5, 1994
INVENTOR(S) : M. N. Harandi

It is certified that error appears in the above-indentified patent and that said Letters Patent is hereby corrected as shown below:

In column 8, line 30 "fractioning" should be --fractionating--

In column 8 line 60 "3701" should be --370--

Signed and Sealed this

Fifteenth Day of November, 1994

Bruce Lehman

*Attest:*

BRUCE LEHMAN

*Attesting Officer*

*Commissioner of Patents and Trademarks*